United States Patent [19]

Canela

[11] Patent Number: 4,944,519

[45] Date of Patent: Jul. 31, 1990

[54] BOARD GAME FOR MEMORIZING MESSAGES, SLOGANS OR PHRASES

[76] Inventor: Heriberto Canela, 8027 W. 14 Avenue, Hialeah, Fla. 33014

[21] Appl. No.: 393,207

[22] Filed: Aug. 14, 1989

[51] Int. Cl.[5] ..... A63F 3/00

[52] U.S. Cl. ..... 273/243; 273/273; 273/272; 273/299; 273/300

[58] Field of Search ..... 273/273, 299, 300, 243, 273/256, 269

[56] References Cited

U.S. PATENT DOCUMENTS

| | | | |
|---|---|---|---|
| 958,258 | 5/1910 | Leach | 273/300 |
| 4,561,658 | 12/1985 | Peterson | 273/243 |
| 4,606,546 | 8/1986 | Rita | 273/269 |

*Primary Examiner*—Benjamin Layno
*Attorney, Agent, or Firm*—J. Sanchelima

[57] ABSTRACT

A board game that wherein a number of messages have been divided in half in several cards and the players are urged to match them when they receive the cards either originally when they were dealt or subsequently as the game progresses and they take the cards from other players. Game tokens are used to represent each one of the players as they travel around the periphery of the board. Centrally and peripheraly located spaces are provided to correspond with the alphabet and with the pairs of cards of the game. Whenever a player matches two cards with one message he or she can claim one of the centrally disposed spaces. When a player lands on a particular peripheral space, he or she can take the pair previously claimed by another player.

3 Claims, 2 Drawing Sheets

BOARD GAME FOR MEMORIZING MESSAGES, SLOGANS OR PHRASES

BACKGROUND OF THE INVENTION

1. Field of the Invention

The present invention relates to a board game, and more particularly, to such a game that forces a player to memorize a set of messages, slogans or phrases that have been divided in the cards used for the game.

2. Description of the Related Art

A multitude of board games have been designed in the past. These games have had different themes. None of these games, however, include the features of this game that condition the players to memorize a number of slogans, phrases or messages that can be readily adapted depending on who the sponsor of the game is.

SUMMARY OF THE INVENTION

It is one of the main objects of the present invention to provide a game that requires the user to look for complementing phrases, slogans or messages thereby facilitating their memorization.

It is another object of this present invention to provide a game that can be readily adapted to convey different messages depending on the sponsor for the game or the theme to be pursued.

It is yet another object of this present invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
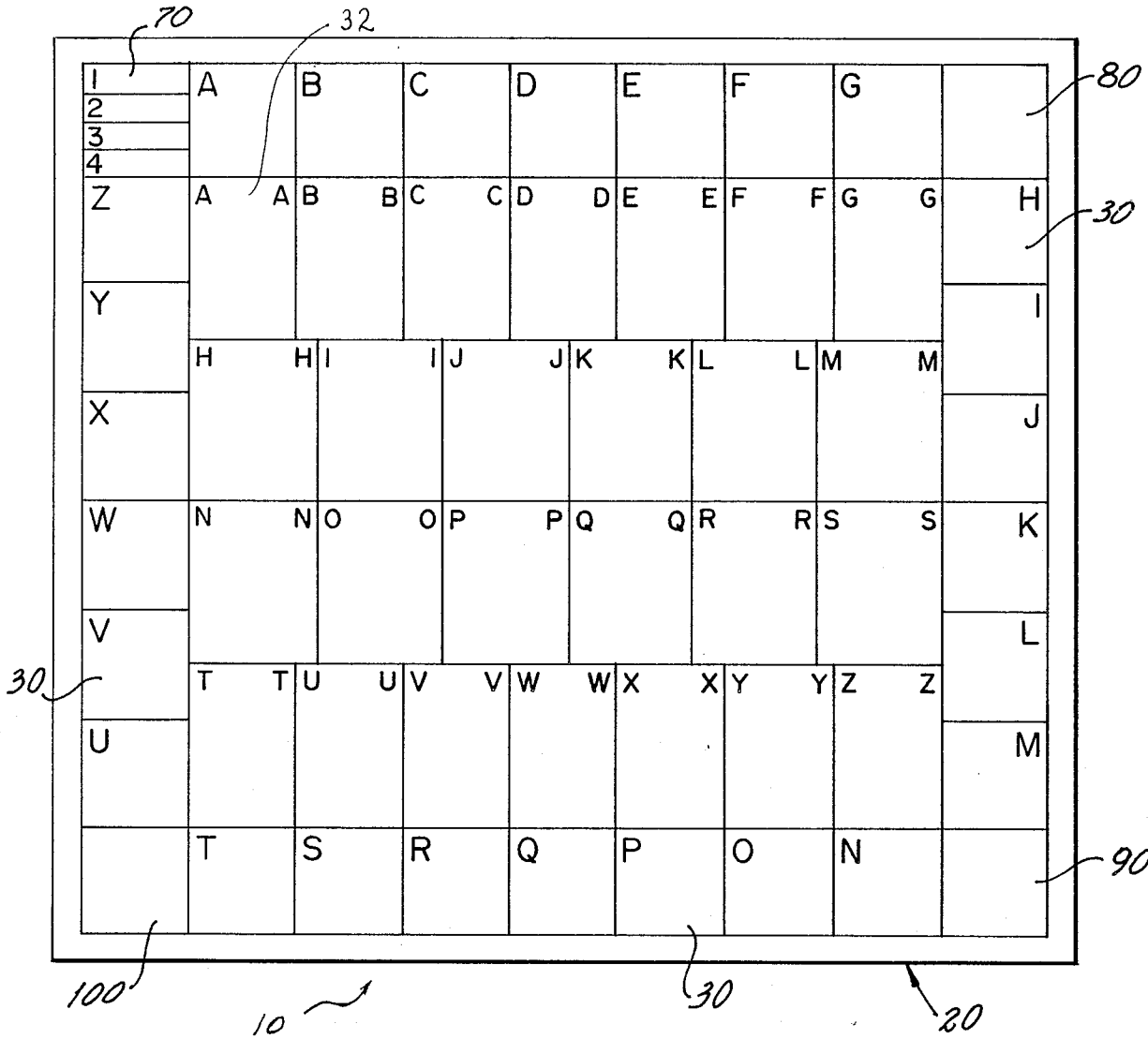
FIG. 1 represents the board game envisioned for the preferred embodiment.
Figure 6:
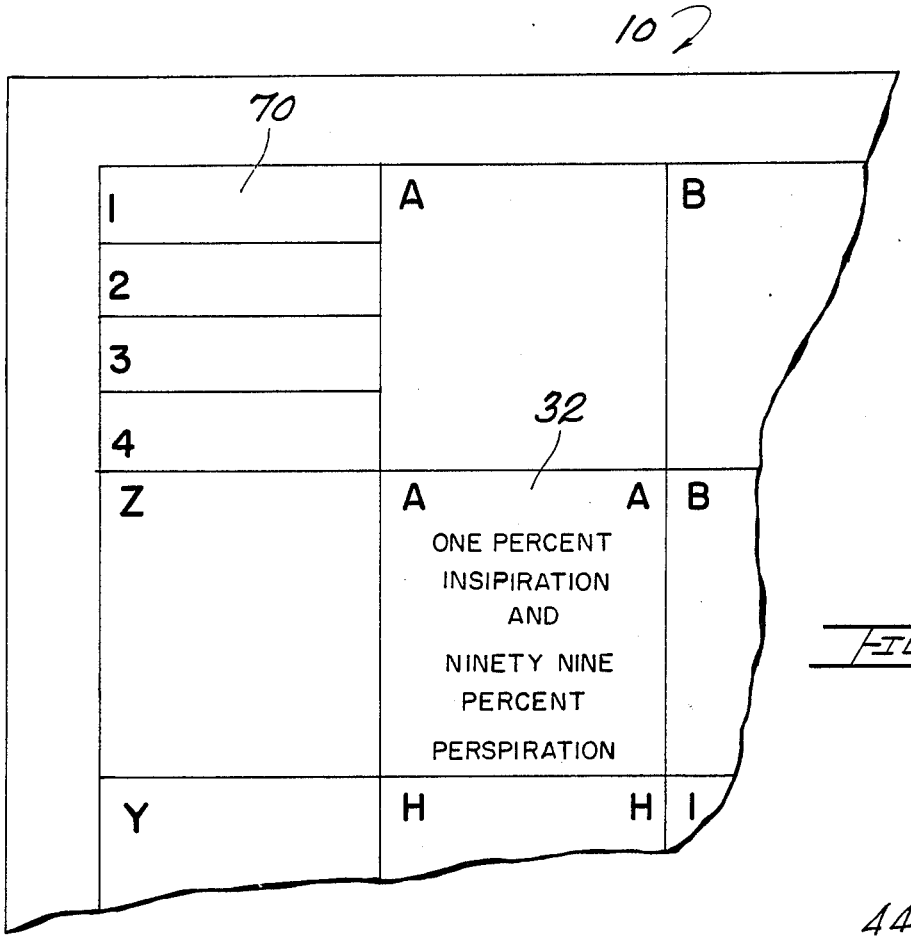
FIG. 6 is representation of a central space having an entire message.
Figure 7:
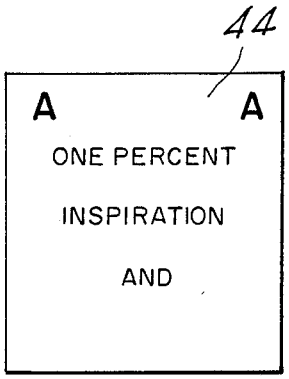
FIG. 7 is a representation of a card having the first portions of the message.
Figure 7A:
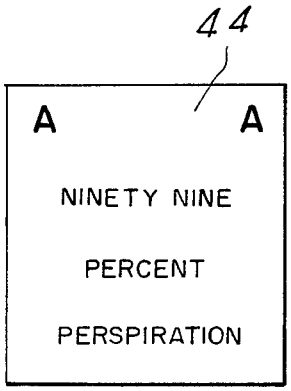
FIG. 7A is a representation of the matching card having the second portion of the message.

Referring now to FIG. 1, where the present invention is generally referred to with numeral 10, it can be observed that it basically includes a preferably square game board 20 that has twenty six peripherally positioned spaces 30 corresponding to each one of the letters of the alphabet. The number of spaces and cards may vary and the alphabet has been chosen here for simplicity only. There are also twenty six centrally disposed spaces 32 also corresponding to the letters of the alphabet. There are four corner spaces on board 20. The one on the upper left, referred to with numeral 70 in FIG. 1, corresponds in the preferred embodiment to the starting space. Corner space 80 on the upper right corresponds to a space that forces a player whose token 50 lands thereon to go back to the starting space without having the opportunity of taking any cards from the player to the right. The lower right corner 90 ask that the player that lands there takes two cards from the player to his or her right. Finally, corner space 100 will require a player to take one card from the player to his or her right and to throw the dice 42 again. Players' tokens 50 will be moved around peripheral spaces 30, according to what dice 42 indicates.

Figure 3:
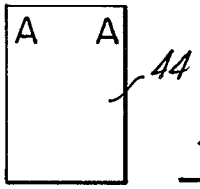
FIG. 3 illustrates is a representation of a card used in the present invention and having two identical letters that symbolize the messages or phrases embodied on the cards.

There are fifty two cards 44, two cards for each letter of the alphabet, and each card has a partial message, slogan or phrase that is intended to be used in the game. A representative card is shown in FIG. 3 where the letters of the alphabet refer to particular spaces 32. Cards 44 shown in FIG. 3 includes the letter A (a letter of the alphabet, number or any other cross-reference). But in practice, the reference letter is not required even though it facilitates locating the corresponding space 32 from either peripheral space 30 or card 44. The idea is to force the player to read and search for partial messages on the cards that he or she holds that complement each other to form an entire message or slogan. Spaces 32 include the entire messages. A player will try to match the pairs of cards 44 that complete the message or slogan and when a player matches a pair, he or she claims a space 32 with token 60.

Figure 2:
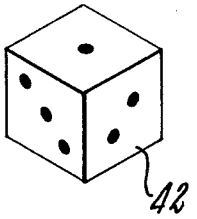
FIG. 2 shows a dice to be used in the present game.
Figure 4:
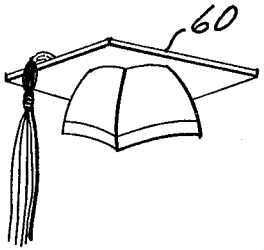
FIG. 4 is a representation of a matched pair of cards token used in the preferred embodiment.
Figure 5:
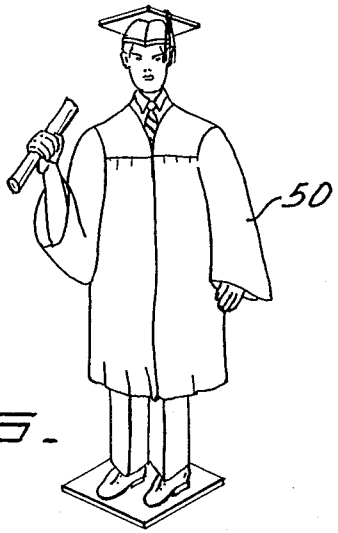
FIG. 5 is a representation of a player's token.

Die 42, as shown in FIG. 2, is used to advance players' tokens 50, as represented in FIG. 5. In the preferred embodiment, four players' tokens are used that are lined up at the starting square on the upper left corner of the board shown in FIG. 1. There are one hundred and four matched pair tokens 60 that are represented in FIG. 4 and these will be divided in four groups of twenty six matched pair tokens 60 each with different colors for each group. These tokens 60 are used to claim matched pairs by placing them on one of central spaces 32 that include the entire message.

To play the game, the dice is rolled to decide who goes first. The second player will be whoever is at the right of the one that played first and so on. The fifty two cards 44 will be initially distributed among the players. Each player will try to identify matching slogans and those cards matched are placed to the side and the player claims one of the central spaces 32 by placing one of his hat token 60 on the respective central space 32. When a player lands on a particular space 30; he or she can take the pair that has been claimed by another player and receive the pair of cards which are symbolically placed by his or her side. As the game progresses, the player' tokens travel around the board and try to match the larger number of card pairs. When a player rolls the dice, he or she will take a card 44 from the player that is to his or her right, preferably. This player getting card 44 will not know which card he or she is getting. However, the objective is to match pairs to claim central spaces 32. To claim a centralk space 32, a player sets aside the matched pair of cards 44. In the search for matching pairs a player will be forced to read and memorize the partial and complete messages. Eventually, when the first player runs out of cards, the game is over. The winner is the player who has matched and claims the largest number of complementing matched pairs.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense.

What is claimed is:

1. A board game, comprising:

A. a board member having an upper surface with a plurality of peripheral spaces with a corresponding plurality of centrally disposed spaces defined thereon and said centrally disposed spaces having one message each;

B. a stack of cards, twice in number as said plurality of centrally disposed spaces, wherein said cards are matched in pairs wherein each one of said matching cards in a pair include complementing parts of said messages;

C. a plurality of player token means that are used to represent each one of the players;

D. dice means for randomly reading symbols to be used to advance said player token means along said peripheral spaces; and E. a plurality of matched pair token means for indicating the pairs of cards matched by a player.

2. The game set forth in claim 1 wherein said plurality of peripherally and centrally disposed spaces are cross-referenced to each other.

3. The game set forth in claim 1 wherein said plurality of peripherally and centrally disposed spaces and said cards are cross-referenced among each themselves thereby facilitating their ready identification.

* * * * *